US007798113B2

(12) United States Patent
Fischer et al.

(10) Patent No.: US 7,798,113 B2
(45) Date of Patent: Sep. 21, 2010

(54) TWO-STEP ROLLER FINGER CAM FOLLOWER ASSEMBLY HAVING A FOLLOWER TRAVEL LIMITER

(75) Inventors: Thomas H. Fischer, Rochester, NY (US); Andrew J. Lipinski, Rochester, NY (US); Hermes A. Fernandez, Pittsford, NY (US); Timothy W. Kunz, Rochester, NY (US); Richard B. Roe, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 589 days.

(21) Appl. No.: 11/820,789

(22) Filed: Jun. 20, 2007

(65) Prior Publication Data

US 2008/0314340 A1 Dec. 25, 2008

(51) Int. Cl.
*F01L 1/18* (2006.01)

(52) U.S. Cl. ..... 123/90.44; 123/90.39; 74/569

(58) Field of Classification Search ..... 123/90.39, 123/90.44, 90.16; 74/559, 567, 569
See application file for complete search history.

(56) References Cited

U.S. PATENT DOCUMENTS 6,769,387 B2 * 8/2004 Hayman et al. ..... 123/90.39
6,925,978 B1 * 8/2005 Gerzseny et al. ..... 123/90.39
6,966,291 B1 * 11/2005 Fischer et al. ..... 123/90.39

* cited by examiner

*Primary Examiner*—Ching Chang
(74) *Attorney, Agent, or Firm*—Thomas N. Twomey

(57) ABSTRACT

A two-step roller finger follower assembly for use in conjunction with a camshaft of an internal combustion engine, wherein the camshaft has at least one first lobe and at least one second lobe. The roller finger follower assembly comprises a follower body for engaging the first cam lobe and having a central aperture, a follower pivotably disposed on the follower body in the central aperture for engaging the second cam lobe, and a limiting stop disposed on the follower body for engaging a feature on the follower to limit travel of the follower body with respect to the follower. The limiting stop prevents overtravel of the follower body during valve-deactivation mode of the assembly, thus preventing excessive leak down of an associated hydraulic lash adjuster.

7 Claims, 4 Drawing Sheets

TWO-STEP ROLLER FINGER CAM FOLLOWER ASSEMBLY HAVING A FOLLOWER TRAVEL LIMITER

TECHNICAL FIELD

The present invention relates to roller finger follower assemblies used for valve actuation in overhead cam type internal combustion engines; more particularly to a two-step roller finger follower assembly having a high lift cam follower that is pivotably mounted in a follower body; and most particularly, to such an assembly wherein a limiting stop limits the travel of the high lift cam follower when the two-step roller finger follower assembly is in valve-deactivation mode.

BACKGROUND OF THE INVENTION

Roller Finger Followers (RFF) are widely used in overhead cam internal combustion engines to sequentially open and close the cylinder intake and exhaust valves. In a typical application, the RFF serves to transfer and translate rotary motion of a cam shaft lobe into a pivotal motion of the RFF to thereby open and close an associated valve.

It is known that, for a portion of the duty cycle of a typical multiple-cylinder engine, the performance load can be met by a functionally smaller engine having fewer firing cylinders, and that at low-demand times fuel efficiency can be improved if one or more cylinders of a larger engine can be withdrawn from firing service. It is also known that at times of low torque demand, valves may be opened to only a low lift position to conserve fuel, and that at times of high torque demand, the valves may be opened wider to a high lift position to admit more fuel. It is known in the art to accomplish this by de-activating a portion of the valve train associated with pre-selected cylinders in any of various ways. One way is by providing a special two-step RFF assembly having a variably activatable and deactivatable central slider arm (also referred to herein as a high-lift follower) pivotably mounted on a follower body wherein the slider arm may be positioned for contact with a high-lift lobe of the camshaft. Such a two-step RFF typically is also configured with rollers disposed on the follower body at each side of the slider arm for contact with low-lift lobes of the camshaft on either side of the high-lift lobe. The follower body is pivotably mounted on a hydraulic lash adjuster (HLA) at one end and engages a valve stem or tappet at the other end. Thus, the two-step RFF causes low lift of the associated valve when the slider arm of the RFF is unlatched from the body in a deactivated (lost motion) position, and high lift of the associated valve when the slider arm of the RFF is latched to the body in an activated position to respond to the high lift lobe of the cam shaft.

Due to the mass moment of inertia of the high lift follower, a spring having a substantial spring load is required to ensure that continuous contact is maintained between the high-lift follower and the camshaft lobe at all camshaft rotational speeds. When the follower assembly is in valve deactivation mode and the high-lift follower is on the base circle of the cam lobe, the reaction force of the follower spring must be lower than the spring force within the HLA to permit the HLA to fully extend and eliminate mechanical lash in the valve train. If the follower spring is stronger than the HLA spring, the HLA will be gradually forced to leak down. When the amount of leak down exceeds the available volume of oil within the HLA's oil reserve chamber, the HLA will not recover and will engulf air. This causes problems with its hydraulic stiffness and can result in engine noise and error in an ensuing valve lift event.

What is needed in the art is a means that permits use of a follower spring having sufficient strength to maintain contact of the high-lift follower at all engine speeds, yet prevents compression of an associated HLA to a point of unacceptable leakdown.

It is a principal object of the present invention to maintain contact of a high-lift follower at all engine speeds without allowing compression of an associated HLA to a point of unacceptable leakdown.

SUMMARY OF THE INVENTION

Briefly described, a two-step roller finger follower assembly is provided for use in conjunction with a camshaft of an internal combustion engine, wherein the camshaft has at least one first lobe and at least one second lobe. Preferably, the first lobe is for low valve lift and the second lobe is for high valve lift. The roller finger follower assembly comprises a follower body for engaging the first cam lobe and includes a central aperture. A high-lift follower is disposed in the central aperture for engaging the second cam lobe, and a limiting stop is disposed on the follower body for engaging a feature on the high lift follower to limit travel of the follower body with respect to the high-lift follower. The limiting stop prevents overtravel of the follower body during valve-deactivation mode of the assembly, thus preventing excessive leak down of an associated hydraulic lash adjuster.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
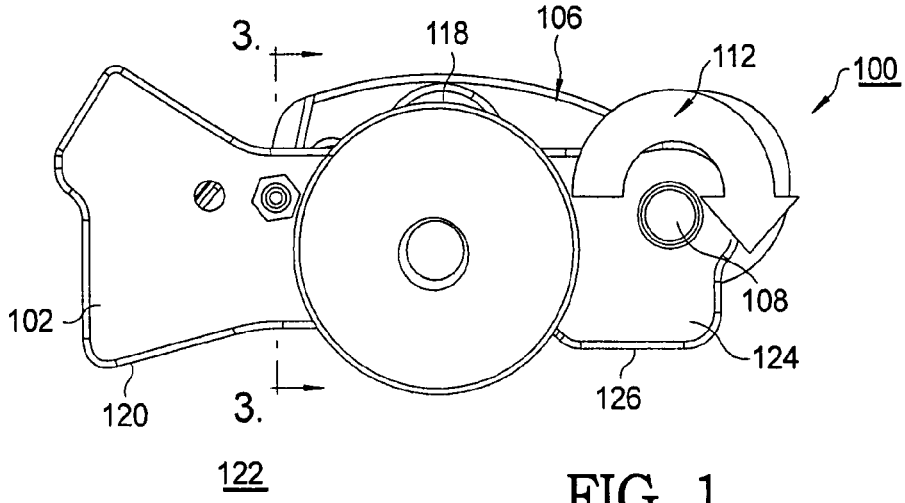
FIG. 1 is a side view of a two-step roller finger follower assembly, showing a first embodiment of the invention.
Figure 2:
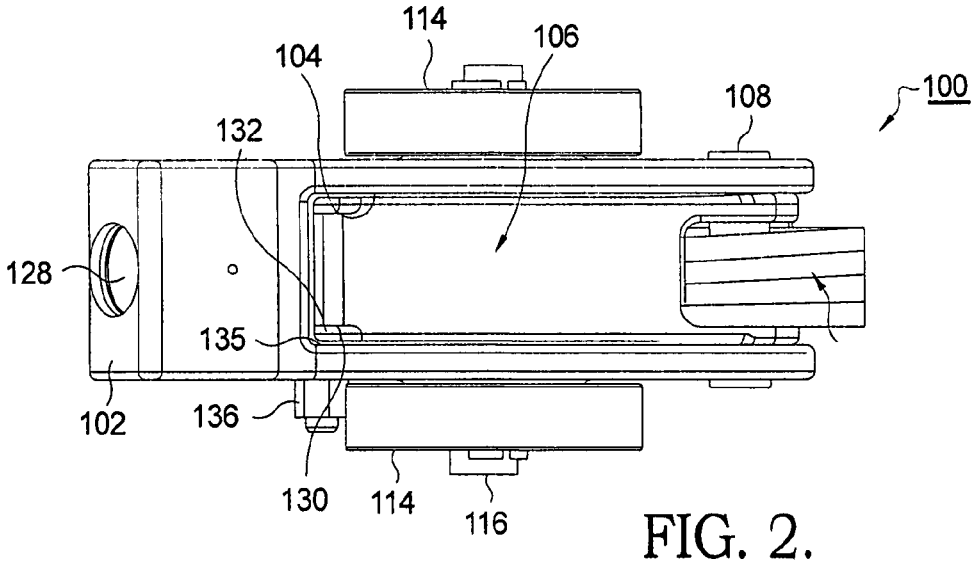
FIG. 2 is a top view of the follower shown in FIG. 1.
Figure 3:
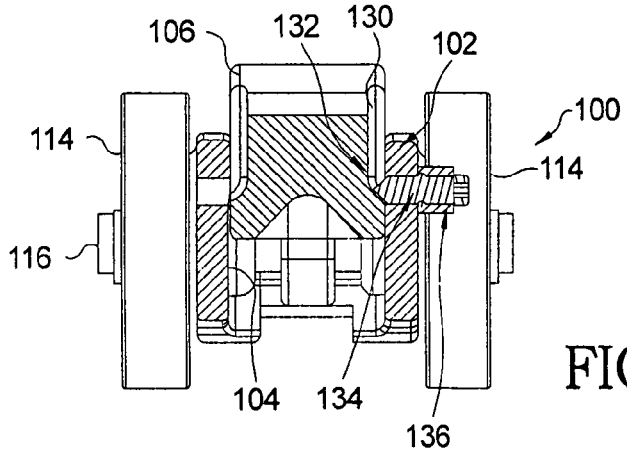
FIG. 3 is a cross-sectional view taken along line 3-3 in FIG. 1.

Referring to FIGS. 1 through 3, a two-step roller finger follower assembly 100 comprises a follower body 102 having a central aperture 104 for receiving a high-lift follower 106 that is pivotably secured to body 102 via a pin 108. A coil torsion bias spring 110 is also disposed on pin 108 and is grounded at a first tang on body 102 and at a second tang on high-lift follower 106 such that follower 106 is urged rotationally within central aperture 104 and about pin 108 in a direction 112. First and second rollers 114 are mounted on an axle 116 that is mounted, preferably on needle bearings (not shown), in a bore through the sidewalls of body 102. Axle 116 passes through an arcuate slot 118 in high-lift follower 106, permitting the follower to rotate freely about pin 108 as just described. A first end 120 of body 102 includes a hemispherical socket (not visible) for pivotably receiving the spherical head of a hydraulic lash adjuster (not shown) upon which follower assembly 100 is mounted in an engine 122. A second end 124 of body 102 includes a pallet surface 126 for engaging and actuating the stem of an engine valve (not shown). Body 102 is further provided with a bore 128 for receiving a latching pin mechanism (not shown) for latching and unlatching high-lift follower 106 from body 102 in known fashion which need not be elaborated upon here.

In accordance with the invention and a first embodiment thereof, high lift follower 106 is provided with a relief 130 along one or both sides thereof, creating a land 132 that preferably is sloped with respect to the direction of travel of follower 106. A limiting stop 134 comprising a screw is threadedly received in a threaded bore in body 102 and extends into central aperture 104 and relief 130 so as to engage land 132 at a predetermined limit of rotational travel of follower 106 in direction 112 with respect to body 102. Preferably, limiting stop screw 134 is tapered at the inner end thereof 135 to permit adjustment of the engagement point with land 132 and thus adjustment of the limit of rotational travel of follower 106. A lock nut 136 may be provided to secure screw 134 in a set position as desired.

Figure 4:
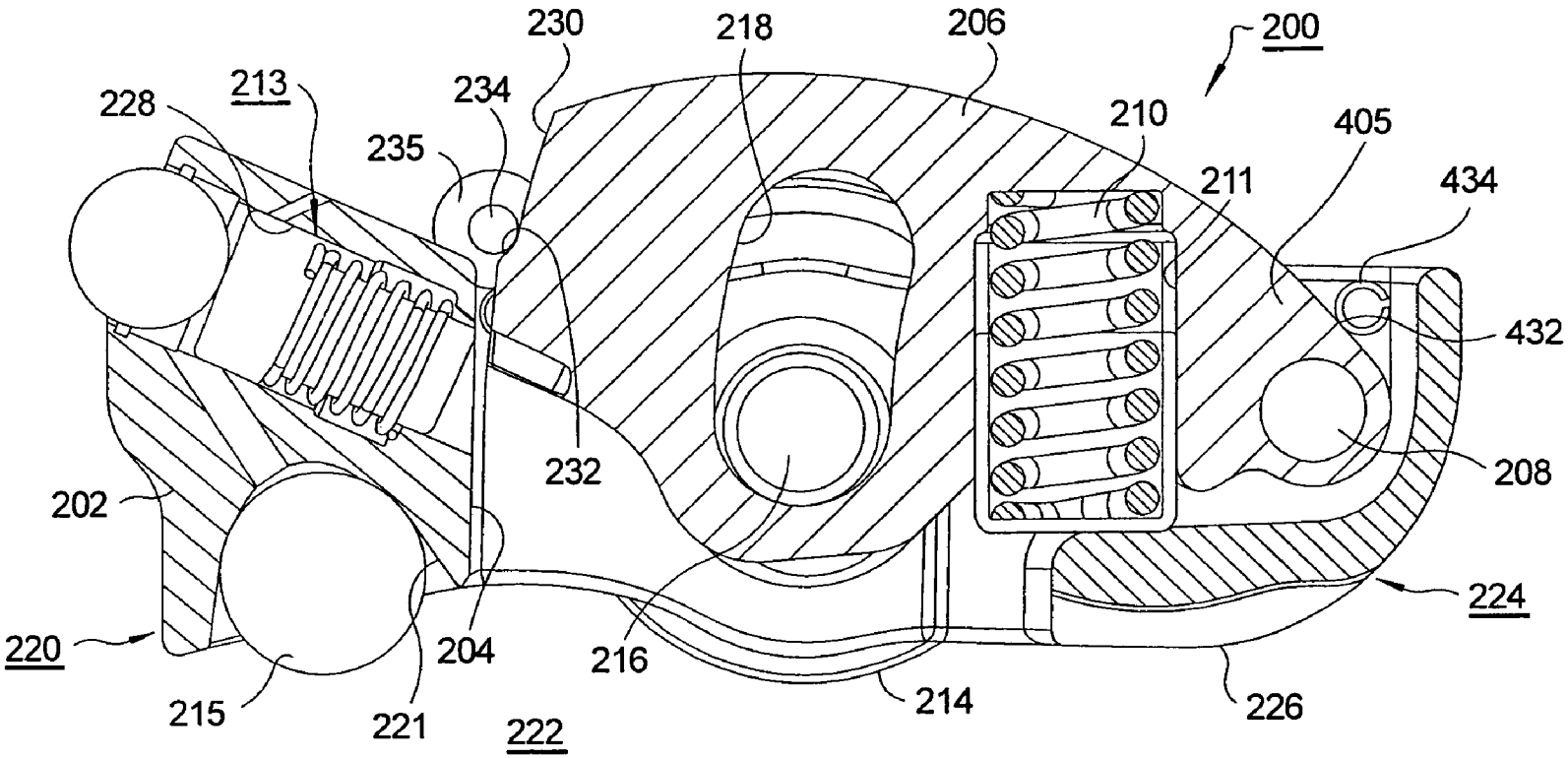
FIG. 4 is a cross-sectional view of a two-step roller finger follower assembly, showing two additional embodiments of the invention.
Figure 5:
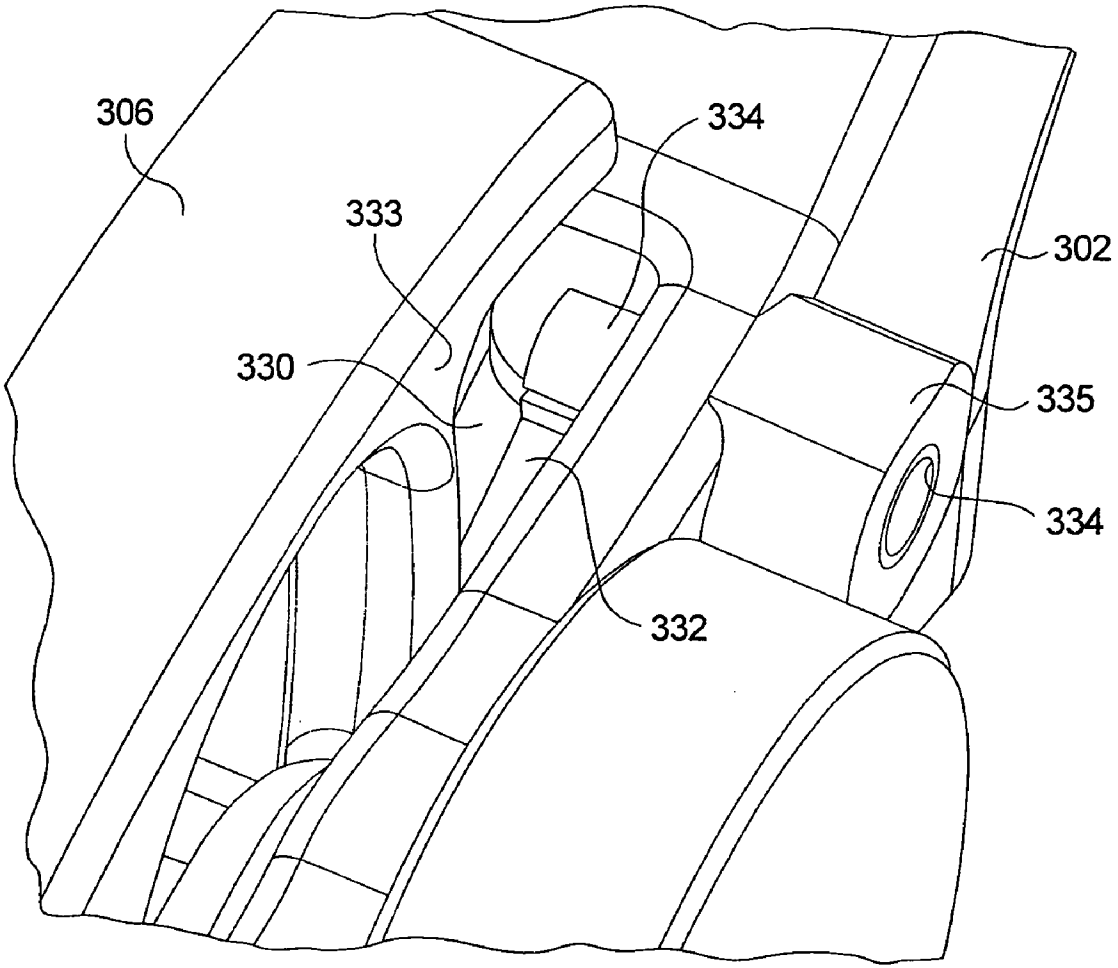
FIG. 5 is an isometric view of the fourth embodiment.
Figure 6:
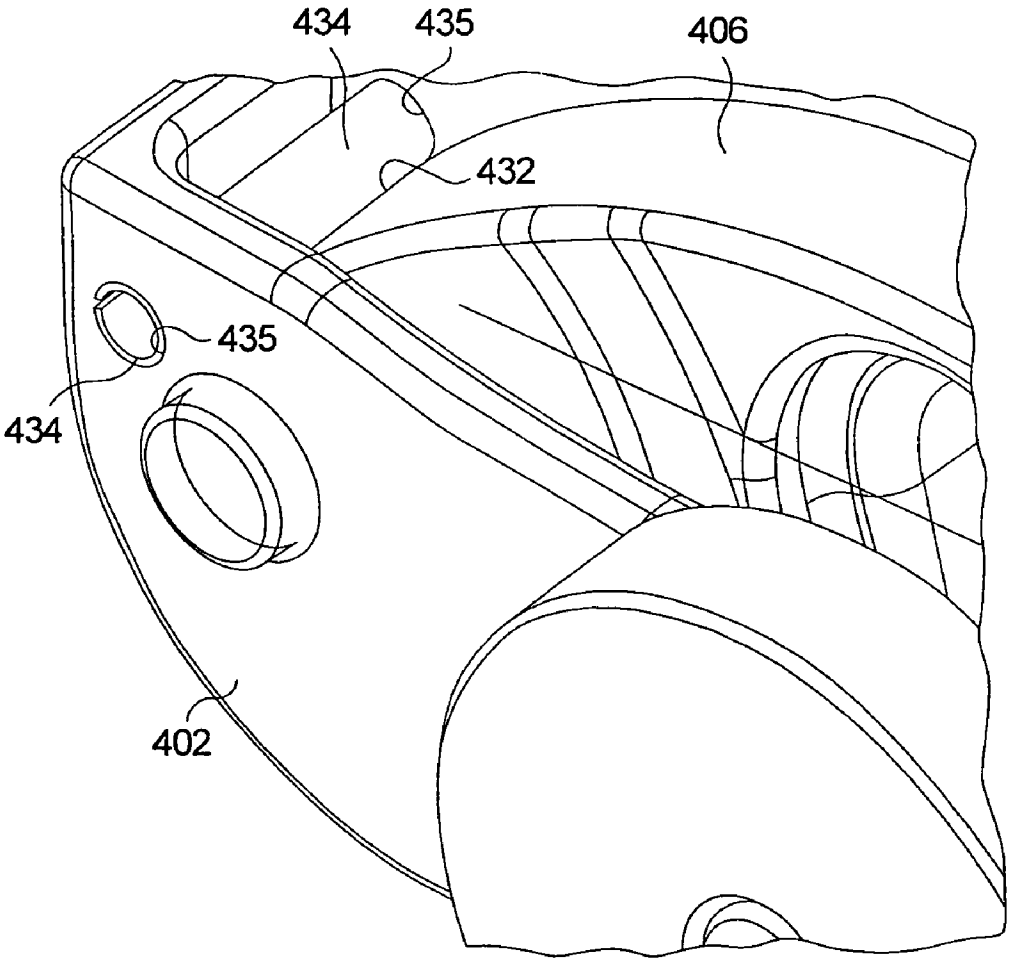
FIG. 6 is an isometric view of the third embodiment shown in FIG. 4.

Referring now to FIGS. 4-6, a second two-step roller finger follower assembly 200 illustrates additional embodiments of a limiting stop in accordance with the invention. Two of the embodiments are shown together in assembly 200 for illustrative purposes but are intended to be used in the alternative.

Assembly 200 is mechanically essentially identical with assembly 100 except that a compression spring 210 in a well 211 formed in high-lift follower 206 replaces torsion spring 110 in embodiment 100. Also note that a latching mechanism 213 of a similar type that would be used in assembly 100, and HLA head 215 are shown.

Assembly 200 comprises a follower body 202 having a central aperture 204 for receiving a high-lift follower 206 that is pivotably secured to body 202 via a pin 208. A roller 214 is mounted on an axle 216 that is mounted, preferably on needle bearings (not shown), in a bore through the sidewalls of body 202. Axle 216 passes through an arcuate slot 218 in high-lift follower 206, permitting the follower to rotate freely about pin 208. A first end 220 of body 202 includes a hemispherical socket 221 for pivotably receiving the spherical head 215 of a hydraulic lash adjuster upon which follower assembly 200 is mounted in an engine 222. A second end 224 of body 202 includes a pallet surface 226 for engaging and actuating the stem of an engine valve (not shown). Body 202 is further provided with a bore 228 for receiving a latching pin mechanism 213 for latching and unlatching high-lift follower 206 from body 202 in known fashion.

In accordance with the invention and a second embodiment thereof, high lift follower 206 is provided with a relief 230 along the latching end thereof, creating a land 232. A limiting stop 234 comprising a roll pin is received in a boss 235 formed in body 202 and extends into relief 230 so as to engage land 232 at a predetermined limit of rotational travel of follower 206 with respect to body 202.

Referring now to FIG. 5, a third embodiment is similar to the just-described second embodiment except that relief 330 and land 332 are formed along the side 333 of follower 306. Boss 335 is placed accordingly such that limiting stop 334, such as a roll pin, extends into relief 330 and engages land 332, thereby limiting the rotation of follower 306 within body 302.

Referring now to FIGS. 4 and 6, a fourth embodiment is operative at the opposite end 405 of follower 406 from the previously-described embodiments. A limiting stop 434, such as a roll pin, is disposed in bores 435 in body 402 at an appropriate location such that motion of follower 406 is arrested by a contact point 432 with limiting stop 434 at an extreme of such motion. Of course, it will be obvious that body 402 may be formed (not shown) in the functional shape of limiting stop 434 and may thereby provide an integral limiting stop at this location.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A two-step roller finger follower assembly for use in conjunction with a camshaft of an internal combustion engine, wherein the camshaft has at least one first lobe and at least one second lobe for engaging said two-step roller finger follower assembly, wherein said two-step roller finger follower assembly comprises:

a) a follower body for engaging said first cam lobe and having a central aperture;

b) a follower movably disposed in said central aperture for engaging said second cam lobe;

c) a latching mechanism for latching and unlatching said follower from said follower body; and d) a limiting stop disposed on said follower body for engaging said follower to limit the range of travel of said follower body with respect to said follower when said latching mechanism causes said follower to be unlatched from said follower body.

2. A two-step roller finger follower assembly in accordance with claim 1 wherein said first cam lobe is a low-lift lobe and said second cam lobe is a high-lift lobe.

3. A two-step roller finger follower in accordance with claim 1 wherein said limiting stop includes a pin mounted in said follower body and extending into the path of motion of said follower.

4. A two-step roller finger follower in accordance with claim 1 wherein said limiting stop is formed integrally with said body.

5. A two-step roller finger follower in accordance with claim 1 wherein said limiting stop is selected from the group consisting of a screw and a roll pin, wherein said limiting stop is mounted in said follower body and extends into the path of motion of said follower.

6. A roller finger follower in accordance with claim 5 wherein the position of said screw in said body is adjustable to vary said limit of said path of motion of said follower.

7. An internal combustion engine including a camshaft having high-lift and low-lift cam lobes, comprising a two-step roller finger follower assembly for selectively adjusting the lift of an associated engine valve, wherein said two-step roller finger follower assembly includes, a follower body for engaging a first of said cam lobes and having a central aperture, a follower movably disposed on said follower body in said central aperture for engaging a second of said cam lobes, a latching mechanism for latching and unlatching said follower from said follower body, and a limiting stop disposed on said follower body for engaging said follower to limit the range of travel of said follower body with respect to said follower when said latching mechanism causes said follower to be unlatched from said follower body.

* * * * *